US012408767B2

(12) United States Patent
Horvath

(10) Patent No.: US 12,408,767 B2
(45) Date of Patent: Sep. 9, 2025

(54) PEG HOOK

(71) Applicant: SENNCO SOLUTIONS INC., Plainfield, IL (US)

(72) Inventor: Daniel L. Horvath, Plainfield, IL (US)

(73) Assignee: SENNCO SOLUTIONS INC., Plainfield, IL (US)

( * ) Notice: Subject to any disclaimer, the term of this patent is extended or adjusted under 35 U.S.C. 154(b) by 0 days.

(21) Appl. No.: 18/234,600

(22) Filed: Aug. 16, 2023

(65) Prior Publication Data

US 2025/0057335 A1 Feb. 20, 2025

(51) Int. Cl.
*G10D 3/00* (2020.01)
*A47F 5/08* (2006.01)

(52) U.S. Cl.
CPC ..... *A47F 5/0838* (2013.01)

(58) Field of Classification Search
CPC ..... A47F 5/0838
See application file for complete search history.

(56) References Cited

U.S. PATENT DOCUMENTS

| | | | | |
|---|---|---|---|---|
| 3,481,482 | A | 12/1969 | Wilkens | |
| 3,827,569 | A | 8/1974 | Canning | |
| 5,711,432 | A | 1/1998 | Stein et al. | |
| 6,481,677 | B1 * | 11/2002 | Yu | A47F 5/083 84/327 |
| 7,484,628 | B2 | 2/2009 | Schneider | |
| 7,768,399 | B2 | 8/2010 | Hachmann et al. | |
| 8,739,981 | B2 | 6/2014 | Piskor | |
| 11,776,517 | B2 * | 10/2023 | Gupta | F16M 11/2014 84/453 |
| 2005/0029208 | A1 * | 2/2005 | Paiste | A47F 7/00 84/421 |
| 2010/0032535 | A1 * | 2/2010 | Elliott | B25H 3/006 248/229.22 |

* cited by examiner

*Primary Examiner* — Amy J. Sterling
(74) *Attorney, Agent, or Firm* — Pauley Erickson & Swanson

(57) ABSTRACT

A peg hook includes a mount and a rod extending from the mount. A tip is pivotally mounted to a distal end of the rod, the tip having a generally straight end and an arcuate body, wherein the tip and the rod each include a flat portion that are pinned to each other to permit the tip to rotate between an extended position and a retracted position.

14 Claims, 5 Drawing Sheets

PEG HOOK

BACKGROUND OF THE INVENTION

Field of the Invention

This invention relates generally to a peg hook and, more particularly, to a theft deterrent peg hook to hinder removal of multiple items simultaneously.

Description of Prior Art

A growing problem for retail stores is theft of high value inventory directly from shelves. Such shelves may include traditional store shelves stocked with multiple products or peg hooks which are likewise stocked with hanging rows of product. Thieves target retail stores to "sweep" shelves of valuable product by quickly assembling and removing as much of the product as possible. They then exit the store with the product before store personnel or law enforcement have an opportunity to react. The product is either later returned for cash or sold outright.

Solutions to this problem have included locking down high value product in vaults or cabinets that require store personnel to unlock and physically provide the product to the consumer. Other solutions include security wires that physically connect the product to store shelves or each other. These solutions also require store personnel to unlock and untether such product for the consumer. These solutions tend to discourage customers from purchases because of the extra effort and time required to examiner and attain a product for purchase.

Other solutions utilize mechanical dispensers connected to shelves that are configured to mechanically dispense one product at a time before resetting for dispensing another product. These solutions do not provide open access to the product to consumers and are not flexible for a variety of inventory.

A need therefore exists in a retail system to slow suspected thieves down, maintain inventory while also enabling shoppers to examine and purchase individual products unencumbered by lock and key solutions.

SUMMARY OF THE INVENTION

The invention generally relates to a theft deterrent system that can be used on a retail shelf peg hooks to protect certain goods from theft.

The general object of the invention can be attained, at least in part, through a theft deterrent peg hook that includes a mount and a rod extending from the mount. A tip is pivotally affixed to a distal end of the rod and is moveable between an extended position and a retracted position.

When a user removes a product from the peg hook, the tip preferably pivots between the extended position and the retracted position as the product is removed. Such pivoting action thereby prevents multiple products from being removed simultaneously. The throttling of product removal thereby mitigates the potential for a thief to "sweep" the peg hook, i.e., remove multiple or all products at once.

Other objects and advantages will be apparent to those skilled in the art from the following detailed description taken in conjunction with the appended claims and drawings.

DETAILED DESCRIPTION OF THE INVENTION

FIGS. 1-11 show peg hooks 10 that can be mounted relative to a retail shelf (not shown) or similar retail fixture.

The peg hook 10 preferably includes a mount 20. The mount 20 may comprise a mounting plate, such as shown in the figures; one, two or more prongs for engaging with a peg board; or other suitable mount 20 for attaching the peg hook 10 to the desired fixture, such as a store shelf, an endcap, or similar retail display.

Figure 1:
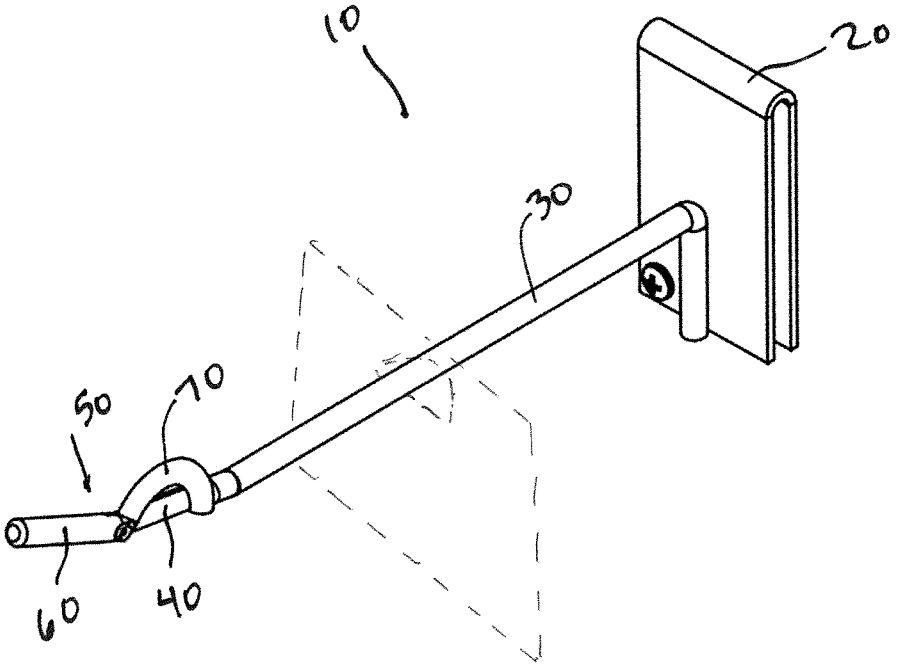
FIG. 1 is a front side perspective view of a peg hook, in an extended position, according to one embodiment of the invention.
Figure 2:
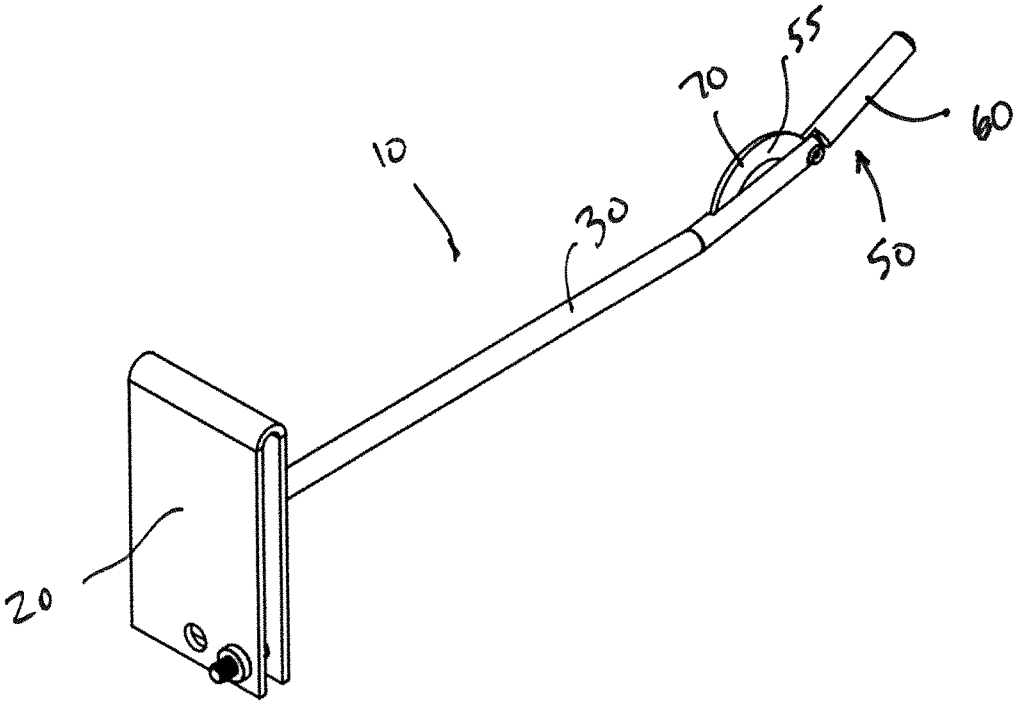
FIG. 2 is a rear side perspective view of the peg hook shown in FIG. 1, in the extended position.

A rod 30 extends from the mount 20. The rod 30 includes a proximal end affixed to the mount 20 and a distal end. The rod 30 is preferably generally straight but may include an elevated portion at the distal end. In this way, products may be hung from the rod 30 and not slide off the end. FIG. 1 shows a product in phantom. Such products typically include a carded header through which an aperture is formed to hang the product from the peg hook 10. Conventional peg hooks are simple rods that extend from a fixture upon which a column of products may be placed. These conventional peg hooks thereby permit a user to slide multiple products off the peg hook in a single action.

As shown in the figures, a tip 50 is pivotally mounted to the distal end of the rod 30. The tip 50 preferably includes a diameter approximately equal to the rod 30. Together, the rod 30 and the tip 50 provide a generally continuous surface for hanging multiple hanging products from the peg hook 10.

Figure 3:
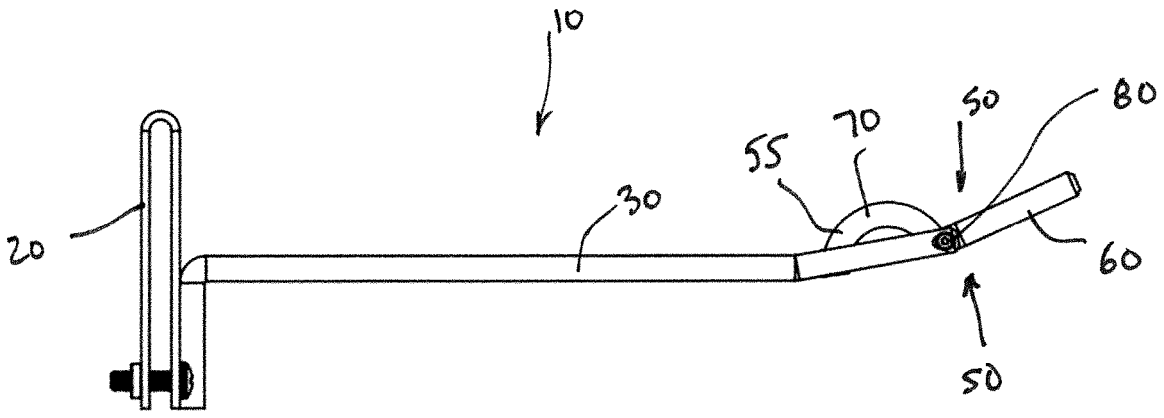
FIG. 3 is a right side view of the peg hook shown in FIG. 1.
Figure 4:
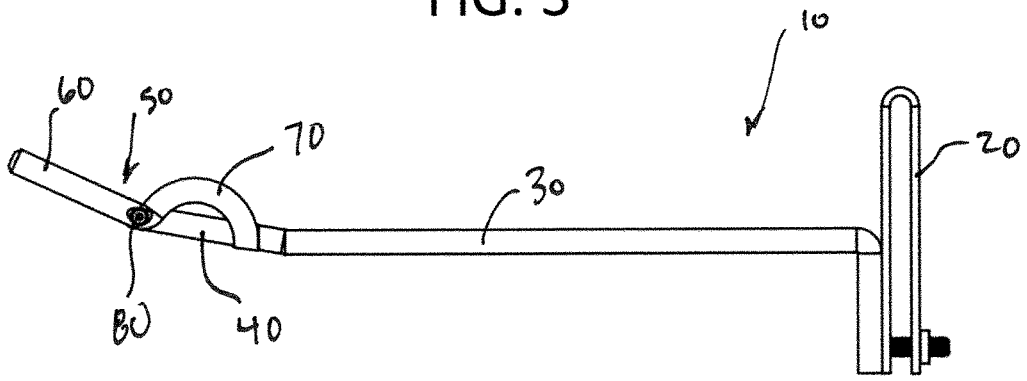
FIG. 4 is a left side view, opposite the right side view shown in FIG. 3, of the peg hook shown in FIG. 1.
Figure 5:
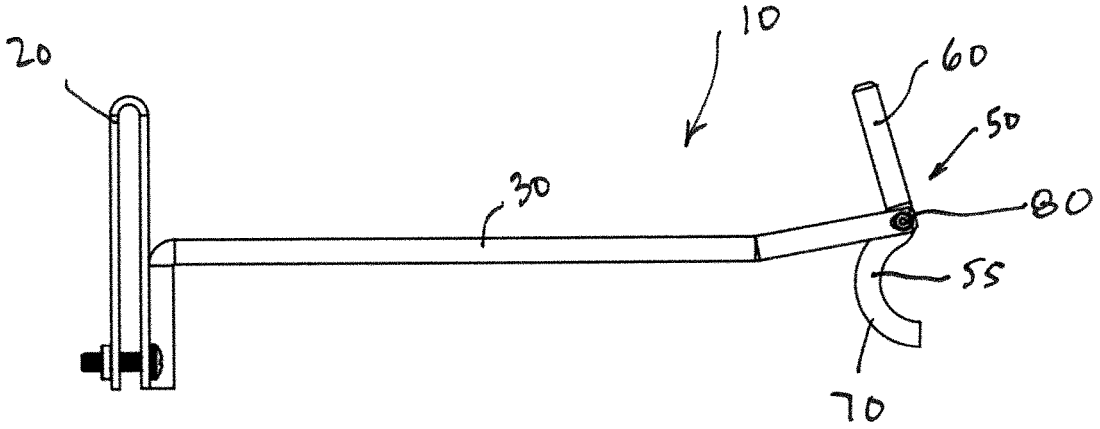
FIG. 5 is a right side view of the peg hook shown in FIG. 1, in a retracted position.
Figure 6:
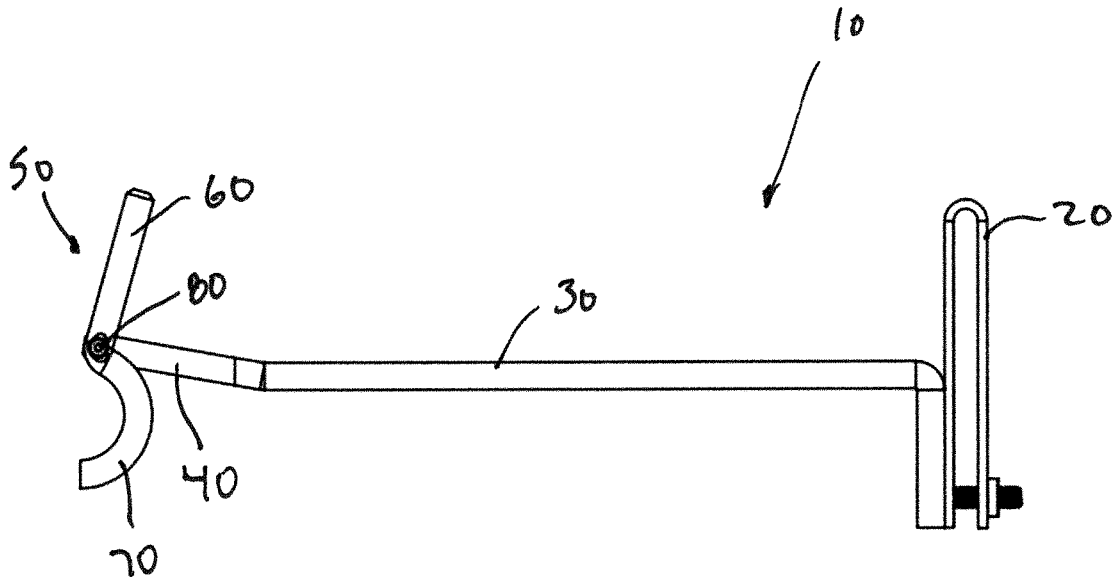
FIG. 6 is a left side view, opposite the right side view shown in FIG. 5, of the peg hook shown in FIG. 1, in the retracted position
Figure 7:
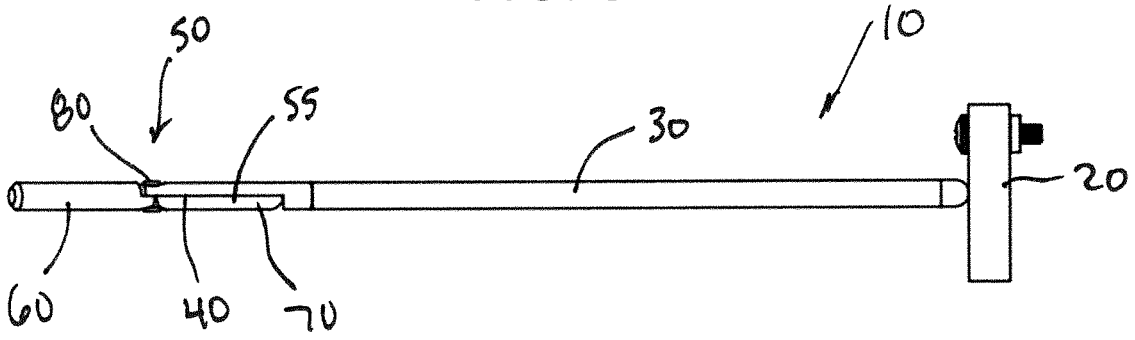
FIG. 7 is a top view of the peg hook shown in FIG. 1.

The tip 50 preferably includes a generally straight end 60 and an arcuate body 70. The tip 50 is preferably affixed to the rod 30 in a pivotable fashion such as through a pin 80. The tip 50 preferably pivots between an extended position whereby the straight end 60 faces outward from the fixture and a retracted position whereby the straight end 60 is angled away from outward facing. FIGS. 3 and 4 best show the peg hook 10 in the extended position. FIGS. 5 and 6 best show the peg hook 10 in the retracted position.

In one preferred embodiment, the tip 50 includes a flat portion 55 and the rod 30 includes a flat portion 40. The respective flat portions 40, 55 are preferably pinned to each other to create the pivoting action of the tip 50 relative to the rod 30.

In a preferred embodiment the flat portion 55 is a D cut and preferably comprises removal of approximately half of the rod 30. Likewise, the flat portion 55 is approximately a half of the cross-section of the tip 50.

As shown in the figures, the tip 50 is connected to the rod 30 at their corresponding flat portions 40, 55. In this connection, the arcuate body 70 of the tip 50 preferably extends across the flat portion 40 of the rod 30. The generally straight end 60 of the tip 50 is generally a consistent diameter and corresponds with the diameter of the majority of the length of the rod 30.

Figure 8:
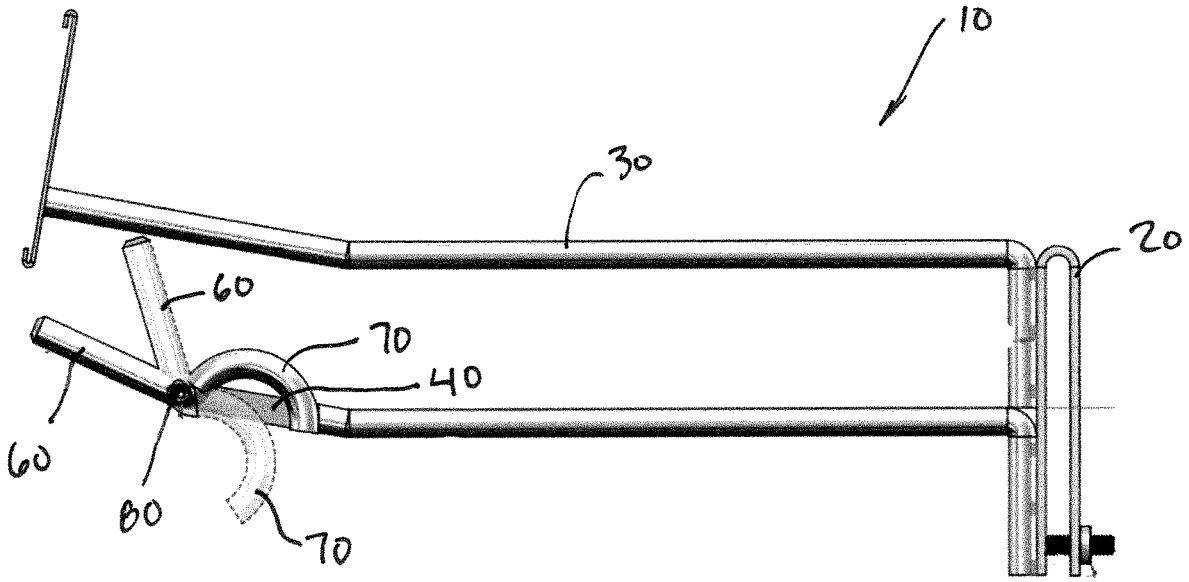
FIG. 8 is a side view of a peg hook according to one embodiment of the invention.
Figure 9:
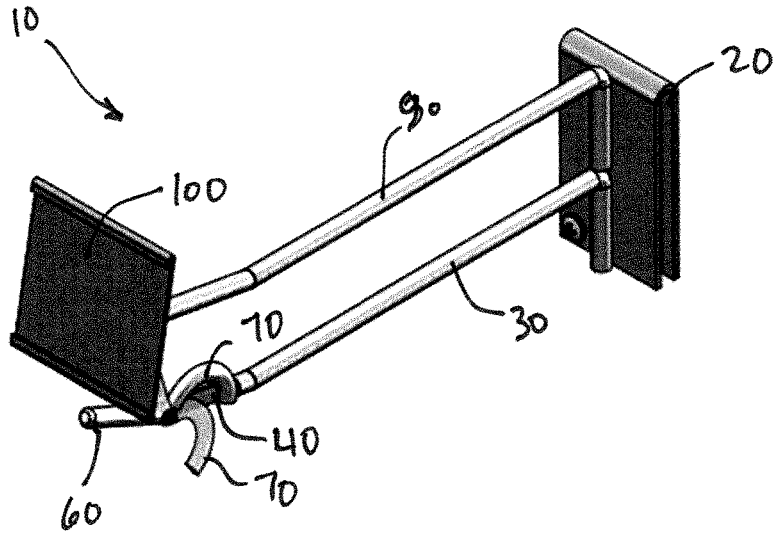
FIG. 9 is a top side perspective view of the peg hook shown in FIG. 8.

The tip 50 is preferably pinned to the rod 30 at a transition between the arcuate body 70 and the generally straight end 60. A pin 80 may be fastened between the rod 30 and the tip 50 to enable the connection and rotation between the extended position and the retracted position. In this pinned arrangement, the tip 50 is configured to rotate between an extended position and a retracted position during removal of products from the peg hook 10. Specifically, the tip 50 is preferably configured to rotate between an extended position wherein the arcuate body 70 extends above the rod 30 and a retracted position wherein the arcuate body 70 extends below the rod 30. This extended position is best shown in FIGS. 3 and 4 and the retracted position is best shown in FIGS. 5 and 6. FIGS. 8 and 9 illustrate both positions within the same drawings.

In use, when a user removes a product from the peg hook 10, the tip 50 preferably pivots between the extended position and the retracted position as the product is removed. Such pivoting action thereby prevents multiple products from being removed simultaneously as the arcuate body 70 and the straight end 60 of the tip 50 combine to block successive product from removal. The throttling of product removal thereby mitigates the potential for a thief to "sweep" the peg hook 10, i.e., remove multiple or all products at once.

The peg hook 10 is preferably configured so the tip 50 is elevated from the rod 30. In addition, the distal end of the rod 30 is preferably elevated from a remaining length of the rod 30 and specifically the proximal end of the rod 30 at the mount 20.

Figure 10:
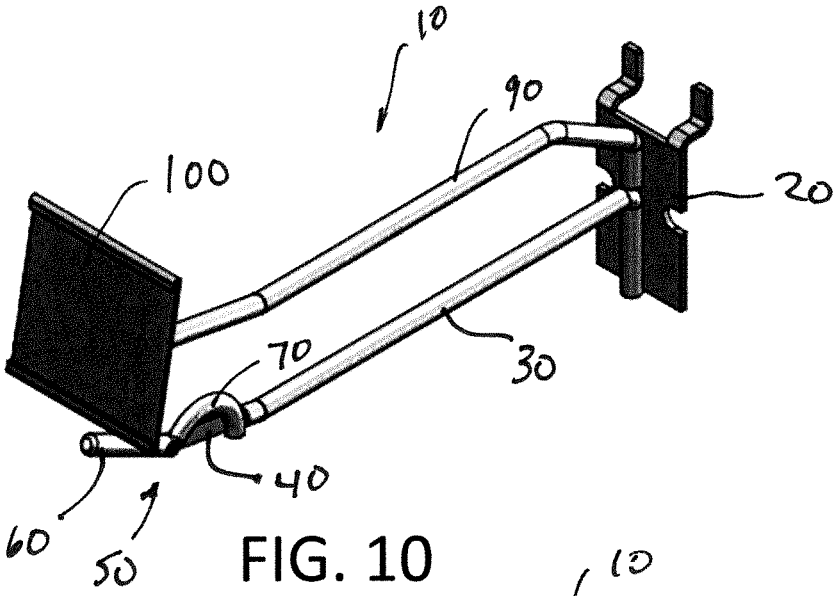
FIG. 10 is a top side perspective view of a peg hook according to one embodiment of the invention.
Figure 11:
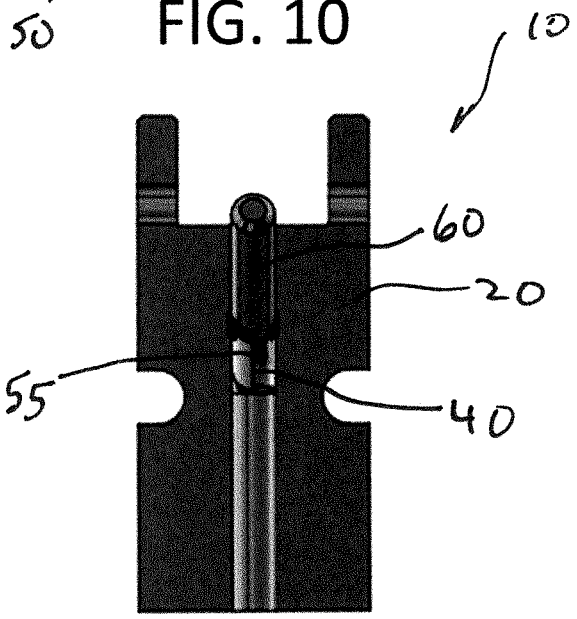
FIG. 11 is a front view of a peg hook according to one embodiment of the invention.

According to an embodiment shown in FIGS. 8-10, the peg hook 10 may further include a second rod 90 extending from the mount 20 generally parallel to the rod 30. The second rod 90 may include a tag holder or similar plate 100 mounted to an end of the second rod 90. The plate 100 is preferably positioned forward of the tip 50 and may accommodate product and/or pricing information.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A peg hook for a product having a header with an aperture configured to engage with the peg hook, the peg hook comprising:

a mount;

a rod extending from the mount, the rod having a diameter and a proximal end and a distal end; and a tip pivotally mounted to the distal end of the rod, the tip having a diameter approximately equal to the rod and a generally straight end and an arcuate body, wherein the tip and the rod each include a flat portion that are pinned to each other and wherein the rod and the tip provide a generally continuous surface for hanging multiple products from the peg hook, and wherein the arcuate body of the tip extends across the flat portion of the rod.

2. The peg hook of claim 1 wherein the flat portion is a D cut.

3. The peg hook of claim 2 wherein the D cut comprises approximately half of the rod.

4. The peg hook of claim 1 wherein the tip is pinned to the rod at a transition between the arcuate body and the generally straight end.

5. The peg hook of claim 1 wherein the tip is configured to rotate between an extended position and a retracted position.

6. The peg hook of claim 1 wherein the tip is elevated from the rod.

7. The peg hook of claim 1 wherein the distal end of the rod is elevated from a remaining length of the rod.

8. A peg hook for a product having a header with an aperture configured to engage with the peg hook, the peg hook comprising:

a mount;

a rod extending from the mount, the rod having a proximal end and a distal end; and a tip pivotally mounted to the distal end of the rod, the tip having a generally straight end and an arcuate body, wherein the tip and the rod each include a flat portion that are pinned to each other, wherein the arcuate body of the tip extends across the flat portion of the rod and wherein the tip is pinned to the rod at a transition between the arcuate body and the generally straight end and wherein the rod and the tip provide a generally continuous surface for hanging multiple products from the peg hook, and wherein the arcuate body of the tip extends across the flat portion of the rod.

9. The peg hook of claim 8 wherein the tip is elevated from the rod.

10. The peg hook of claim 8 wherein the distal end of the rod is elevated from a remaining length of the rod.

11. A peg hook for a product having a header with an aperture configured to engage with the peg hook, the peg hook comprising:

a mount;

a rod extending from the mount, the rod having a proximal end and a distal end; and a tip pivotally mounted to the distal end of the rod, the tip having a generally straight end and an arcuate body, wherein the tip and the rod each include a flat portion that are pinned to each other, wherein the tip is configured to rotate between an extended position wherein the arcuate body extends above the rod and a retracted position wherein the arcuate body extends below the rod and wherein the rod and the tip provide a generally continuous surface for hanging multiple products from the peg hook and wherein the arcuate body of the tip extends across the flat portion of the rod.

12. The peg hook of claim 11 wherein the tip is pinned to the rod at a transition between the arcuate body and the generally straight end.

13. The peg hook of claim 11 wherein the flat portion is approximately a half of a cross-section of each of the rod and the tip.

14. The peg hook of claim 11 wherein the rod and the straight end of the tip are the same diameter.

* * * * *